US006810203B2

(12) United States Patent
Alban et al.

(10) Patent No.: US 6,810,203 B2
(45) Date of Patent: Oct. 26, 2004

(54) ELECTRICAL MOTOR VEHICLE AIR HEATER WITH GROUNDED HOUSING

(75) Inventors: Thomas Alban, Massenbachhausen (DE); Dirk Wenske, Ludwigsburg (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/373,040

(22) Filed: Feb. 26, 2003

(65) Prior Publication Data

US 2003/0180033 A1 Sep. 25, 2003

(30) Foreign Application Priority Data

Feb. 26, 2002 (DE) ..... 102 08 103

(51) Int. Cl.[7] ..... H05B 3/06; F24D 13/00; F24H 3/00

(52) U.S. Cl. ..... 392/347; 392/354; 219/540

(58) Field of Search ..... 392/347, 354, 392/358–359; 219/530, 540, 202, 505, 210, 209, 520, 522, 526, 542

(56) References Cited

U.S. PATENT DOCUMENTS 4,314,270 A * 2/1982 Iwatani ..... 257/708
4,419,564 A * 12/1983 Marcoux ..... 219/206
5,606,639 A * 2/1997 Lehoe et al. ..... 392/353
5,990,459 A 11/1999 Feustel et al.
6,060,699 A * 5/2000 Sakurai et al. ..... 219/541
6,392,207 B2 * 5/2002 Beetz et al. ..... 219/530
2001/0052518 A1 12/2001 Neckel

FOREIGN PATENT DOCUMENTS

| | | |
|---|---|---|
| DE | 196 42 442 A1 | 4/1998 |
| DE | 100 28 446 A1 | 1/2002 |
| EP | 1 253 808 A2 | 10/2002 |
| WO | WO 02/057100 A2 | 7/2002 |

* cited by examiner

*Primary Examiner*—John A. Jeffery
(74) *Attorney, Agent, or Firm*—Nixon Peabody LLP; David S. Safran

(57) ABSTRACT

An electrical air heating apparatus, especially for a motor vehicle, with electrical heating elements (3) for heating air and a housing (1) which has a ground connection **(1*a*), an electrical supply connection and an electronic circuit (7) to control the supplying of electrical power to the heating elements (3). In the housing (1), the heating elements (3) are arranged in electrical contact with the ground connection and the electrical supply connection. The housing (1) is made of an electrically conducting material, for example, aluminum and is constructed in one piece with a molded-on ground connection (1*a*). The heating elements (3) and the electronic circuit (7) are arranged in direct electrical contact with the housing (1)**.

8 Claims, 11 Drawing Sheets

ELECTRICAL MOTOR VEHICLE AIR HEATER WITH GROUNDED HOUSING

BACKGROUND OF THE INVENTION

1. Field of the Invention

The invention relates to an electrical air heating apparatus, in particular for a motor vehicle, with electrical heating elements for heating the air and a housing which has a ground connection, an electrical supply connection and an electronic circuit to control the supply of the heating elements and at which the heating elements are arranged in electrical contact with the ground connection and the electrical supply connection.

2. Description of Related Art

Such an electrical air-heating apparatus in which the electrical heating elements are formed of PTC heating rods is known. In the known heating apparatus, the housing is made of a plastic material in which the heating elements are provided in a casting or sealing compound and are connected to the electrical supply connection via the electronic circuit on one side and to the ground connection via a ground plate and a ground pin electrically connected thereto on the other side.

In the known heating apparatus, the thermal and the mechanical connection between the housing, the electronic circuit and the heating elements is achieved by means of a plurality of components, wherein it is necessary to provide additional fillers, such as adhesives and sealing compounds, to achieve high compensation for tolerances. As well as the actual sealing function, the adhesives and sealing compounds also take on the function of absorbing any forces and moments of the heating apparatus. In this case, however, the sealing and connection between the plastic housing and the heating elements, which are generally formed of aluminum heating rods, are not easily processed and are unreliable. The required lifetime cannot be ensured so far. Furthermore, in the known heating apparatus, the forces appearing are transmitted up to the printed circuit board on which the electronic circuit is provided. As a result of this transmission, there may be some mechanical stressing of the printed circuit board which is associated with a high risk of damage to the electronic components.

SUMMARY OF THE INVENTION

Thus, a primary object of the present invention is to provide an electrical air heating apparatus of the type specified initially which manages with a smaller number of components, especially in the region of its housing.

This object is achieved according to the invention by the housing being constructed of an electrically conducting material in one piece with a molded-on ground connection, and the heating elements and the electronic circuit are arranged in direct electrical contact with the housing.

As a result of the fact that, in the heating apparatus according to the invention, the housing is made of an electrically conducting material and is constructed in one piece with the ground connection, the ground potential lies at the housing so that this not only fulfils the housing function, but also the function of the ground plate, the ground pin and the ground connection for adaptation by the customer, which are present in the known heating apparatus. This has the consequence that the ground plate, the ground pin and the sealing compound which are provided as separate components in the known heating apparatus, are dispensed with in the heating apparatus according to the invention.

Further developments and embodiments of the heating apparatus according to the invention have the advantage that heat can be conducted and removed from the printed circuit board carrying the electronic circuit and the power switches into the heating region, that heat exchange can take place without surface loss by heat transport via breaks in the housing with weight optimization, and that the mechanical fixing of all the components, the fixing of the printed-circuit board, the entire ground contacting of the heating apparatus and the direct ground contacting can be made polarity-safe via the ground connection molded on to the housing for a customer's cable.

In terms of production, there are the advantages that, as a result of the smaller number of components, the number of production steps in series production is smaller and that automated methods can be used.

In addition, the mechanical heat-transfer interfaces for the removal of thermal energy from the power switches into the heating regions are simpler and the heat from the power switches is removed directly via the housing into the actual heating region, wherein the ground contacting can be made polarity-safe via the ground connection and the forces and moments from the heating region can be absorbed without providing additional components.

Preferred embodiments of the heating apparatus according to the invention are described in detail in the following with reference to the accompanying drawings.

DETAILED DESCRIPTION OF THE INVENTION

Figure 1:
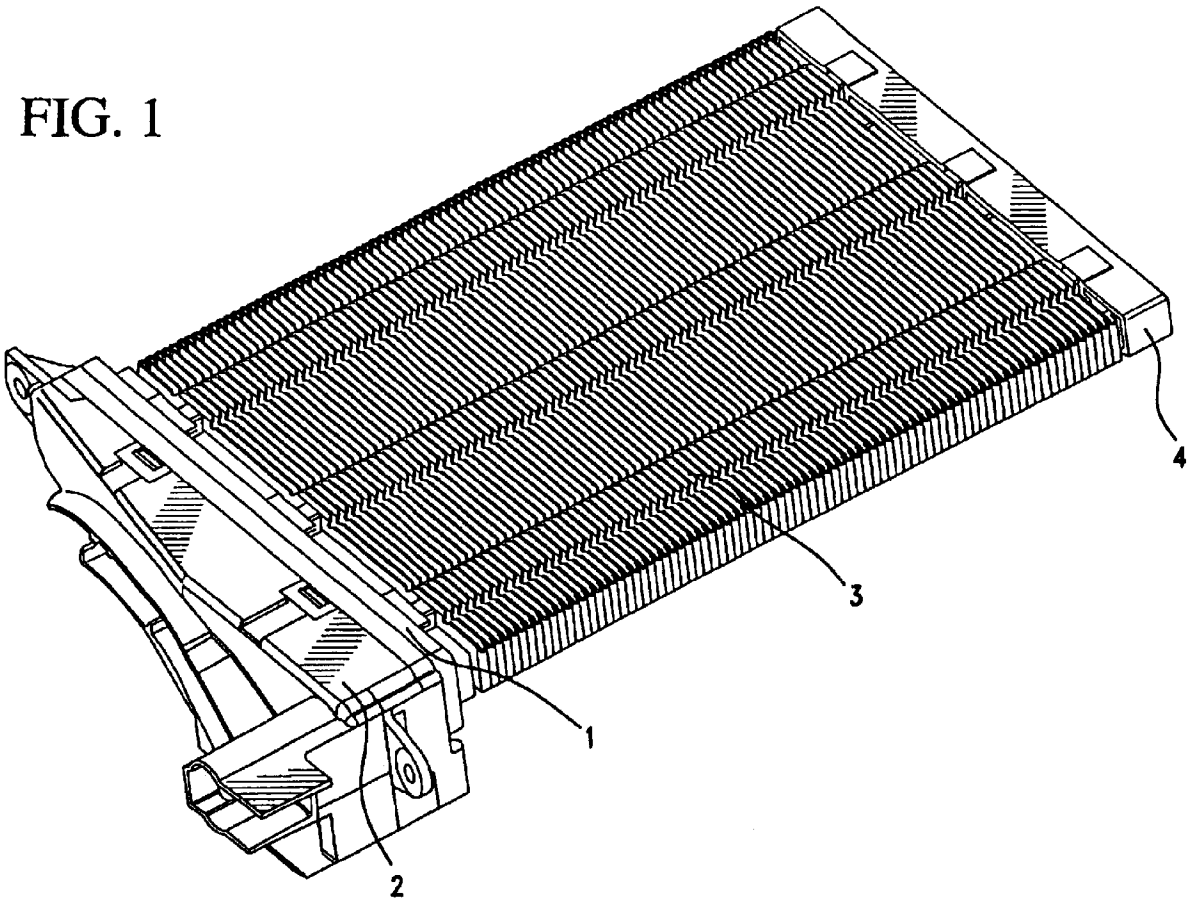
FIG. 1 is a perspective view of an embodiment of an air heating apparatus with PTC heating elements.

The embodiment of an electrical heating apparatus especially for an motor vehicle shown in FIG. 1 substantially comprises electrical heating elements 3 which are arranged, on one side, on a distal counter or outer support 4, and on the other side, on a housing 1 that is closed by a housing cover 2.

Figure 2:
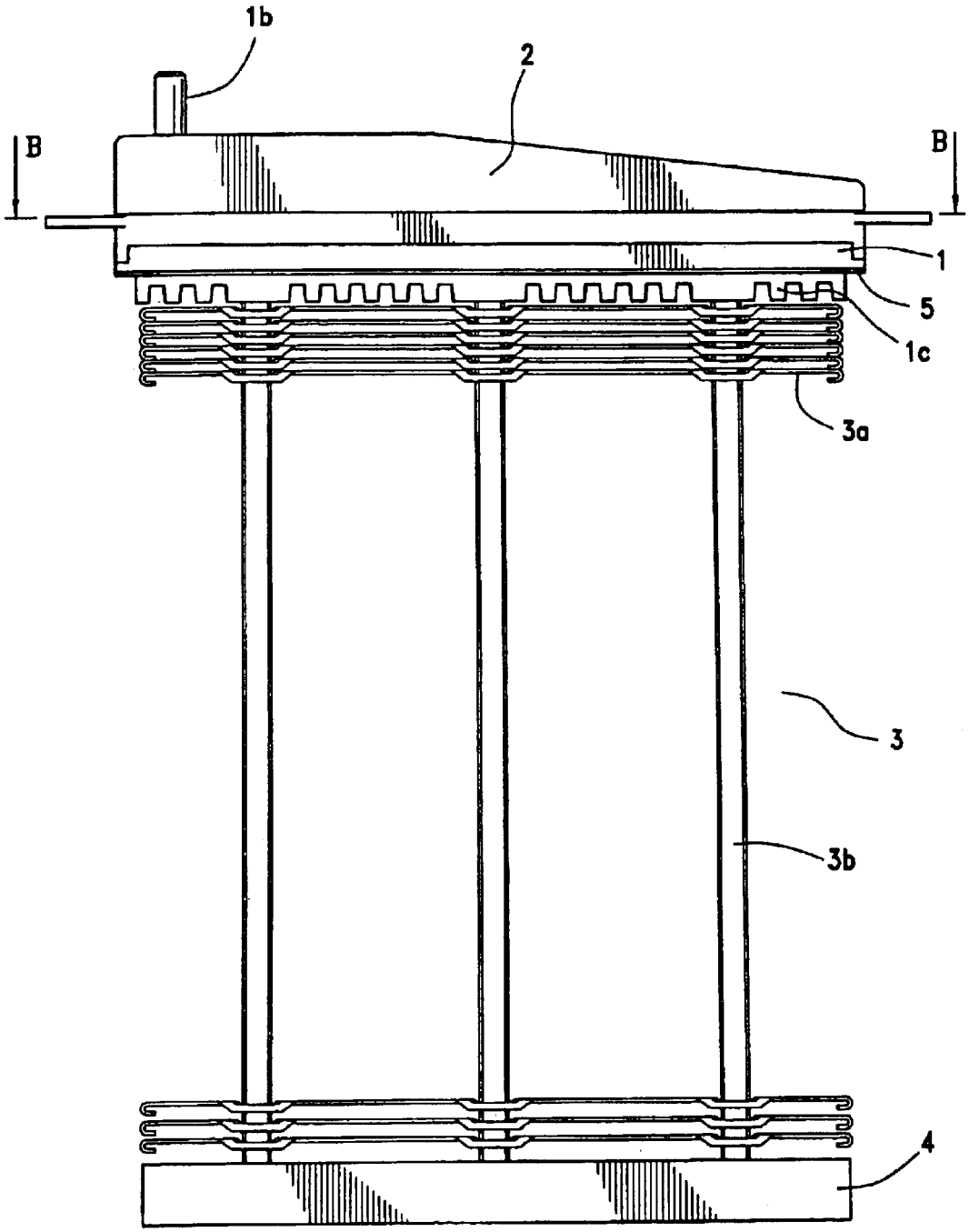
FIG. 2 is a front view of the heating apparatus shown in FIG. 1.
Figure 3:
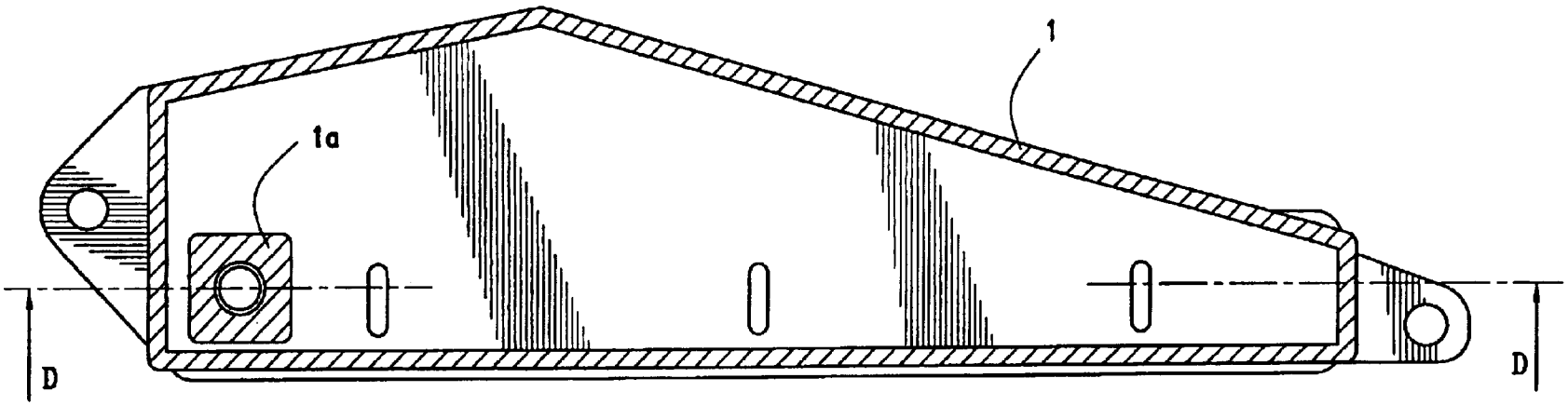
FIG. 3 is a sectional view along the line B—B in FIG. 2 with the printed circuit board.
Figure 4:
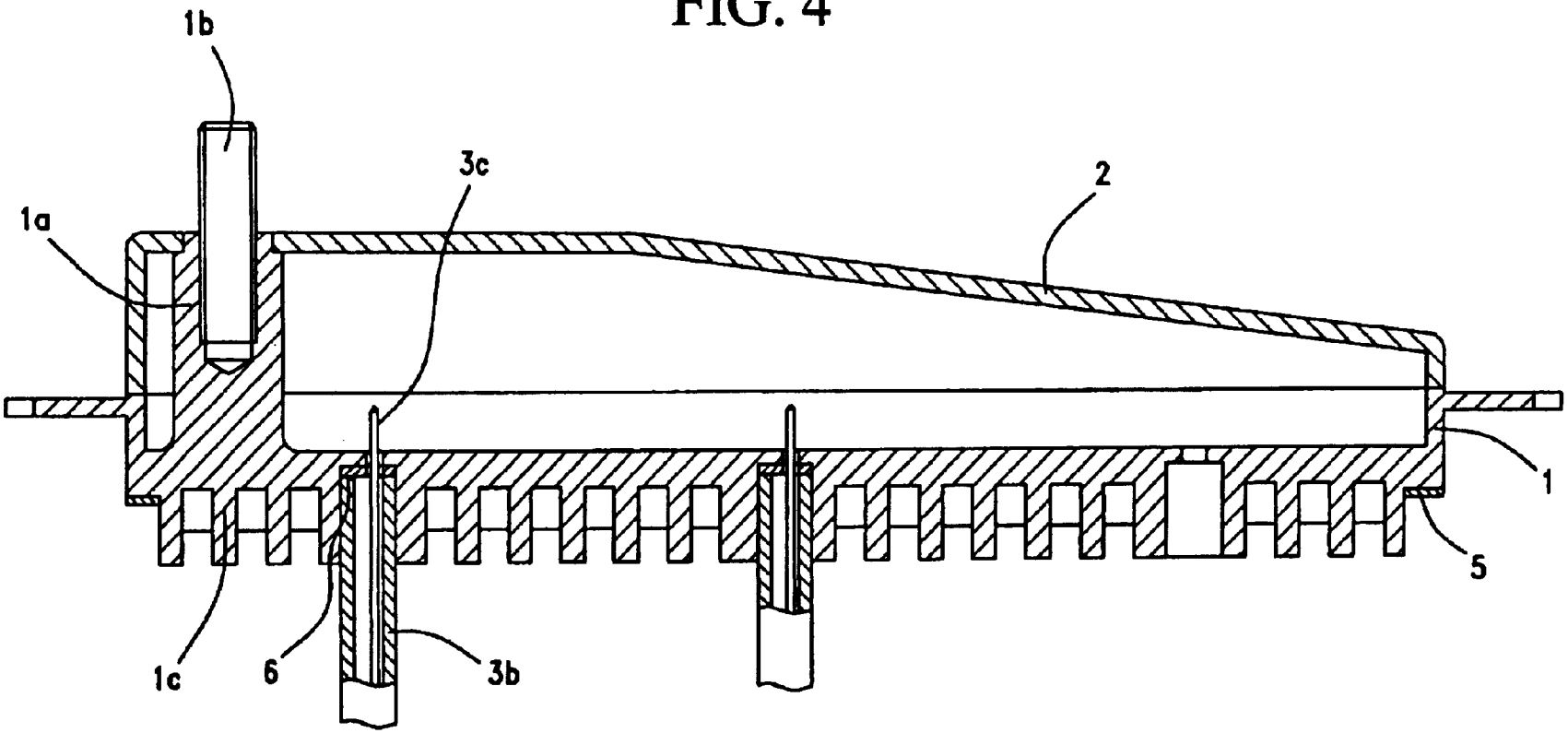
FIG. 4 is a sectional view along the line D—D in FIG. 3.
Figure 5:
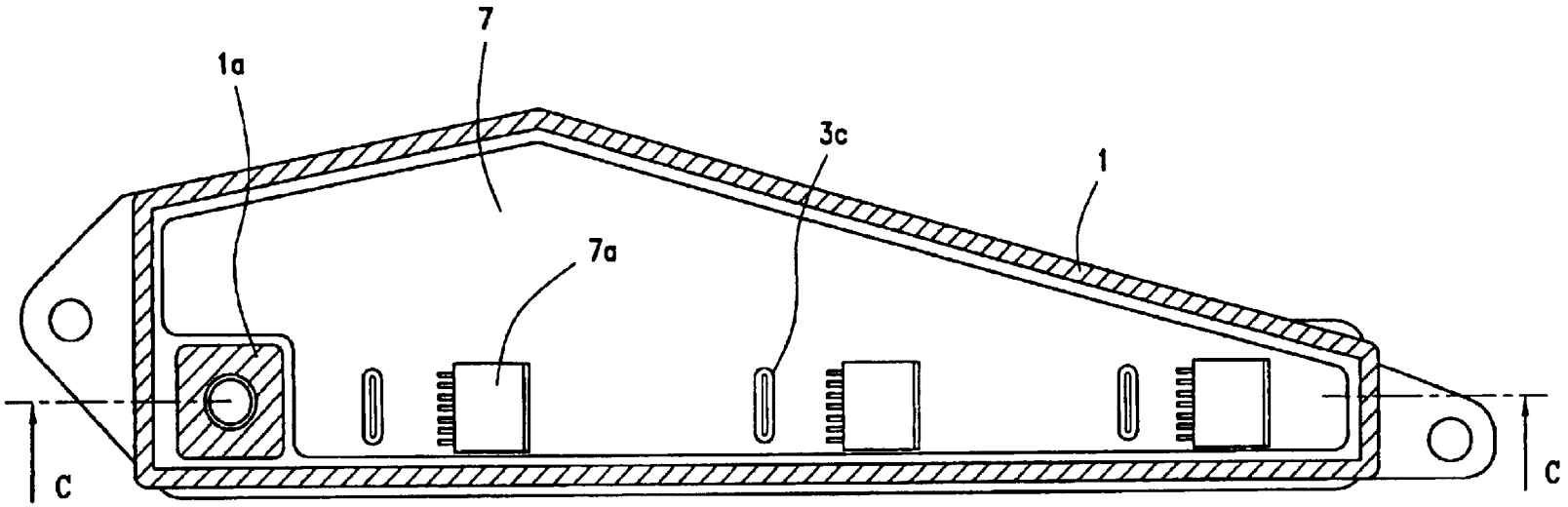
FIG. 5 is a sectional view along the line B—B in FIG. 2 with the printed circuit board and power switches.

As can be seen in detail in FIG. 2, the heating elements 3 comprise heating rods 3*b* that are filled with PTC bricks. As can be seen from FIG. 6, contact tongues 3*c* are located inside the rods 3*b*, whereby the rods 3*b* make the outer connection on one side. On the rods 3*b* are mounted fins 3*a* which radiate the heat produced when electrical power is supplied to the rods 3*b* to the surrounding air. The outer support 4 is mounted on the heating elements 3 and on the outer connection side of the heating elements 3 there are inserted sealing elements 6 for sealing, through which the contact tongues 3*c* project. The heating elements 3 are pressed onto the housing 1.

Contact with the mounting space, for example, in a motor vehicle is made via a seal 5 provided on the housing 1.

Figure 6:
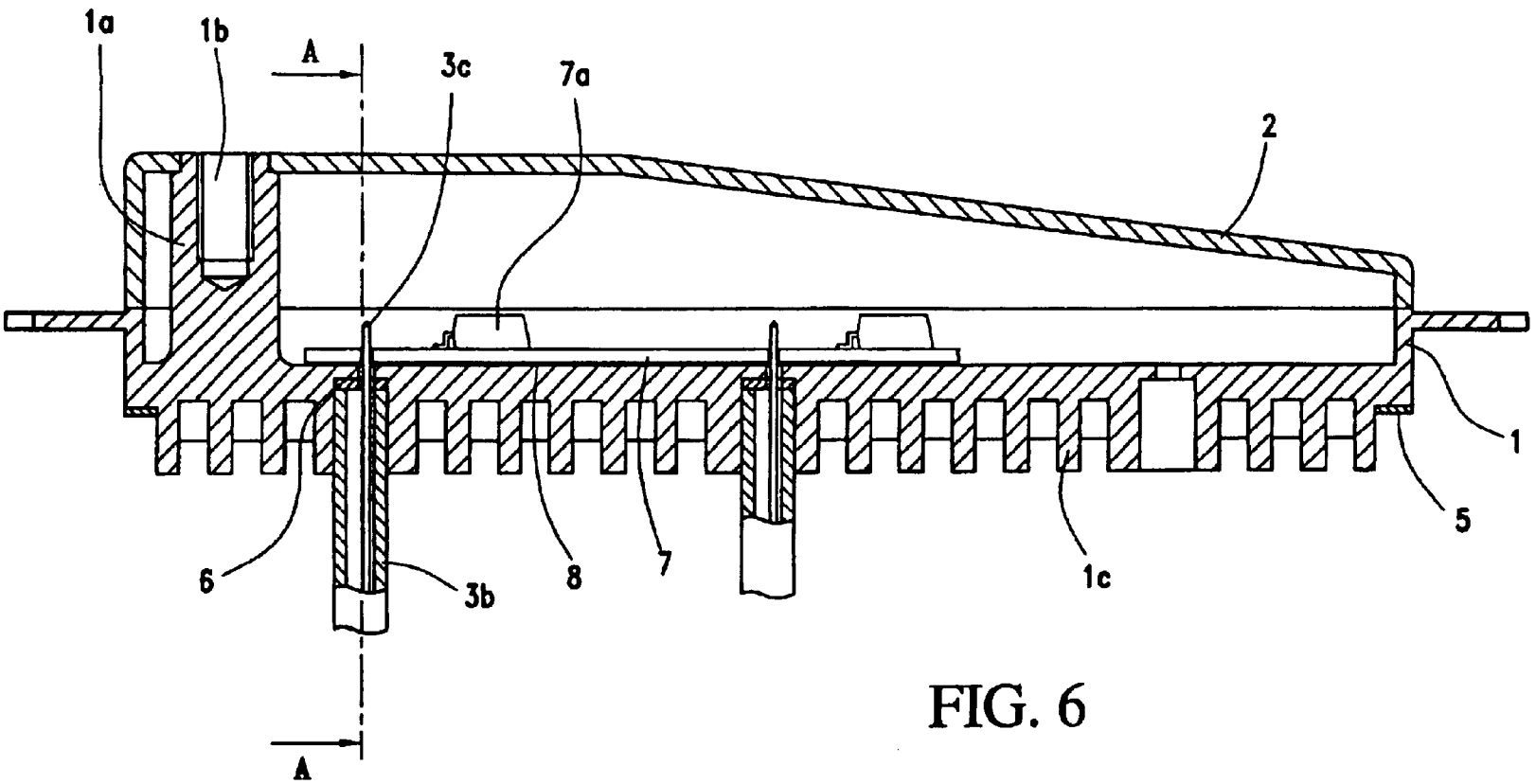
FIG. 6 is a sectional view along the line C—C in FIG. 5.
Figure 7:
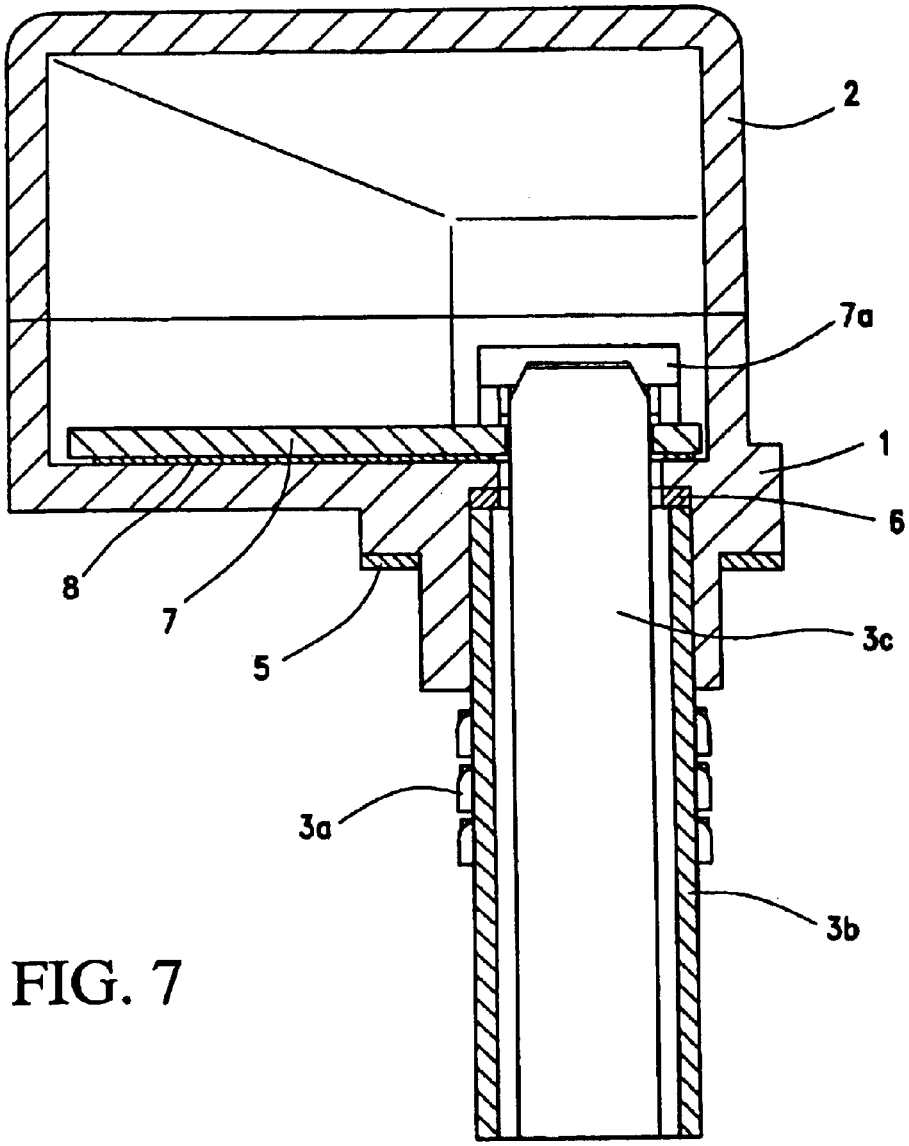
FIG. 7 is a sectional view along the line A—A in FIG. 6.

The housing 1 is made of an electrically conducting material, especially aluminum, and is constructed, in the manner shown in FIG. 6, in one piece with a molded-on ground connection 1*a* in the form of a ground dome. The heating rods 3*b* are connected via the housing 1 and the ground dome 1*a* to the ground connection 1*b*, which can be designed as the customer wishes, and are connected with their contact tongues 3*c* via a printed circuit board 7 fitted with power switches 7*a* to the electrical supply connection, which holds the electronic circuit for controlling the electrical supply of the heating elements 3.

The ground connection 1*b* in the ground dome 1*a* of the housing 1 shown in the drawing is shown in the form of a screw-in bolt but can likewise be constructed as an insert part or a press-in part or can be built-in or fixed in a hole in the ground dome 1*a* by means of a screw.

The printed circuit board 7 equipped with power switches 7*a* for the heating elements is in thermal contact with the housing 1 via a heat-conducting material 8, for example, an adhesive, a paste or a film. By this means, the heat produced during operation of the power switch 7*a* is transported via the printed-circuit board 7 and the heat-conducting material 8 into the housing 1, and from there, via the heating elements 3, namely the rods 3*b* to the fins 3*a*, which radiate this heat to the surrounding air.

Figure 9:
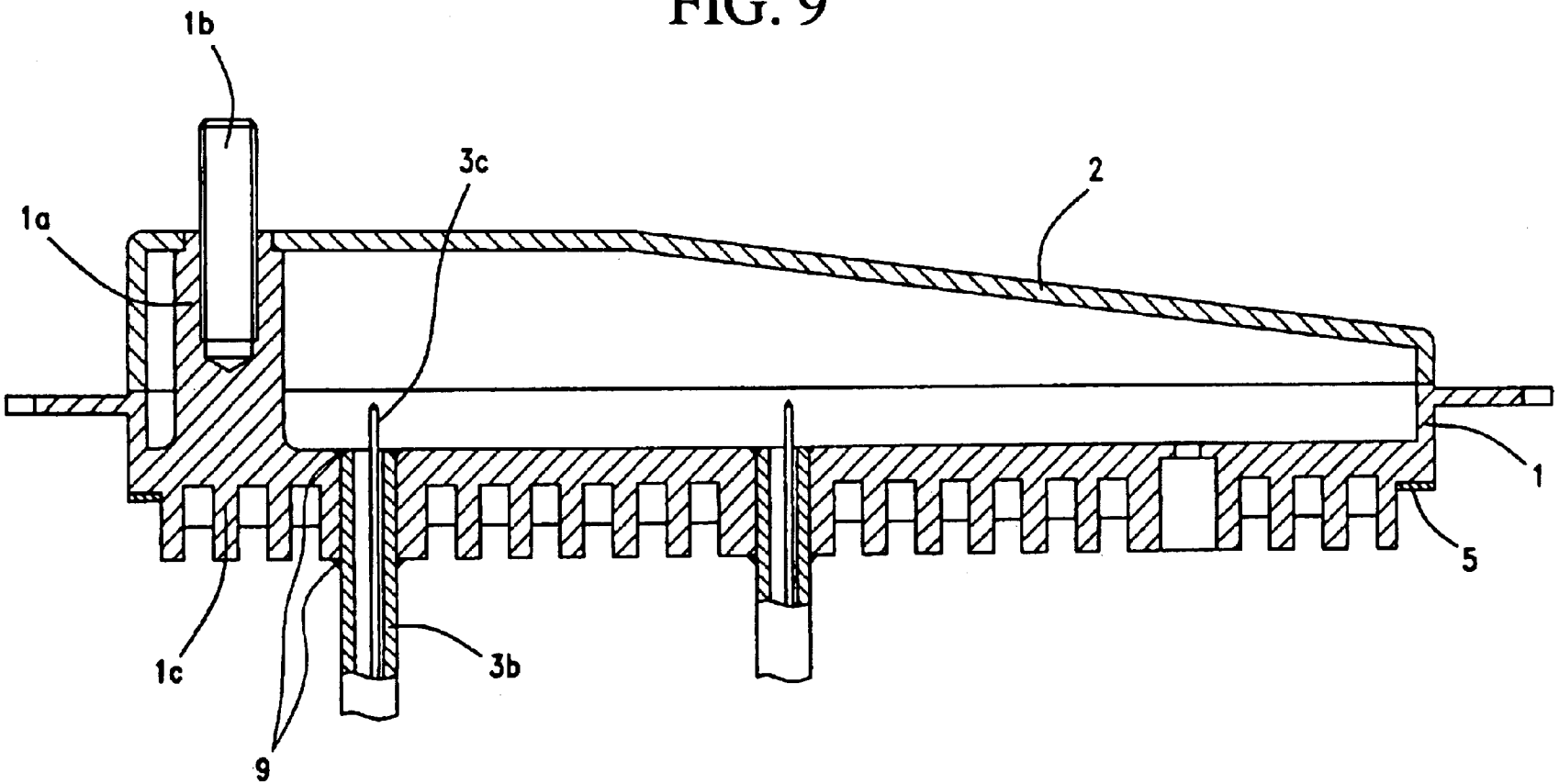
FIG. 9 is a modified embodiment of the heating apparatus according to the invention in a sectional view along the line D—D in FIG. 3.
Figure 10:
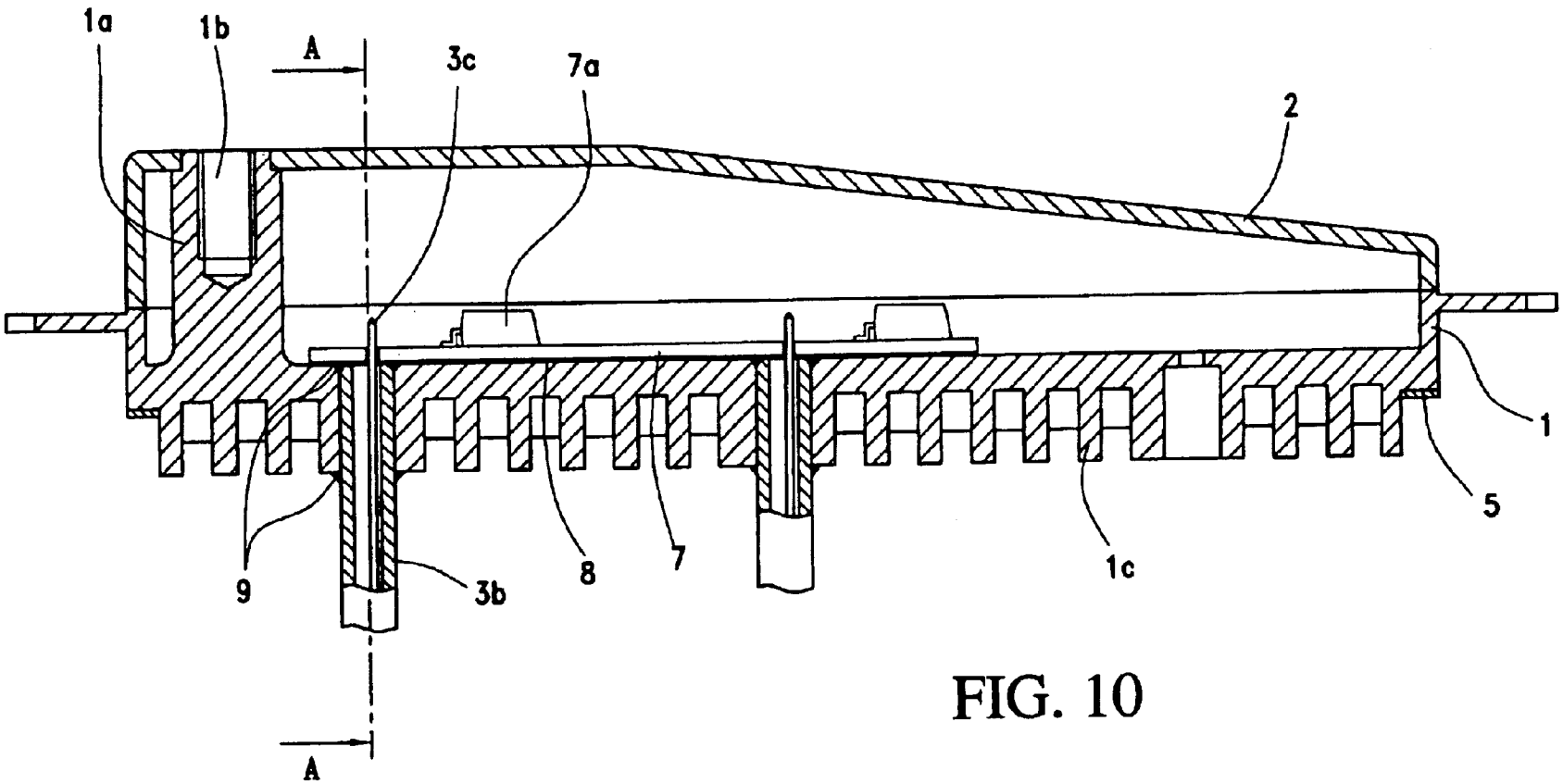
FIG. 10 is the modified embodiment in a sectional view along the line C—C in FIG. 5
Figure 11:
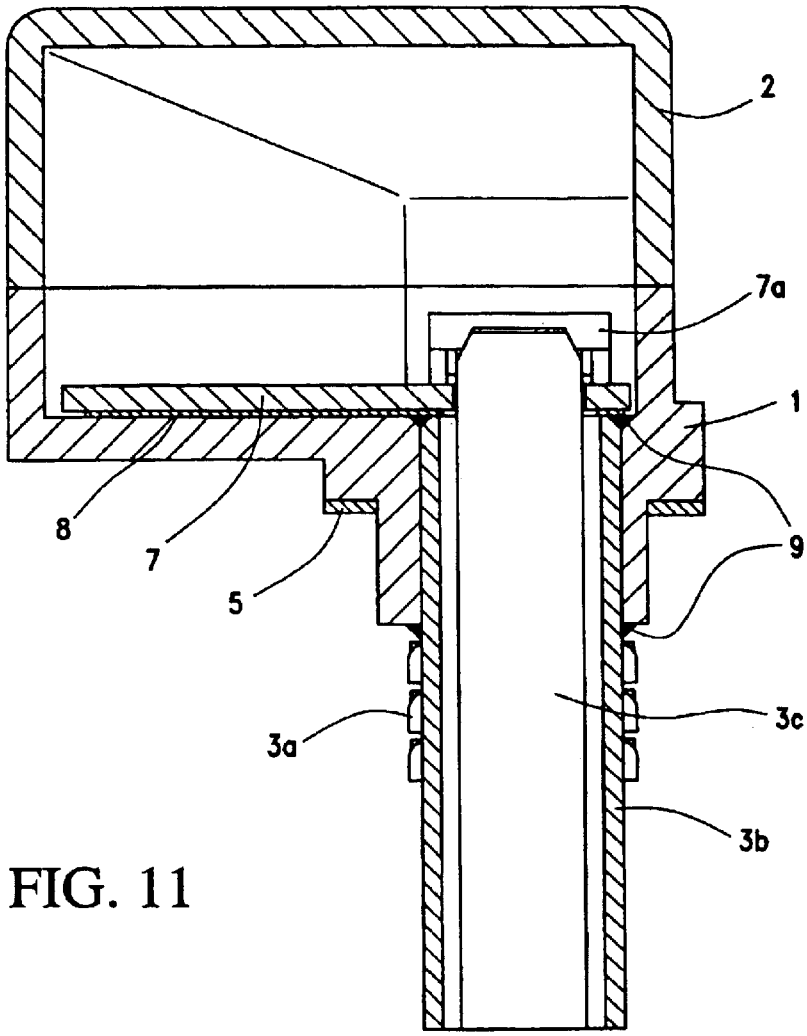
FIG. 11 is the modified embodiment in a sectional view along the line A—A in FIG. 10.

In the modified embodiment of the heating apparatus according to the invention shown in FIGS. 9 to 11, the sealing elements 6 provided in the first embodiment are missing and the heating rods 3*b* are instead welded to the housing 1 via a welded joint 9, with or without admixed material. The corresponding welded seam, which is formed on the rods 3*a* after assembly of the housing 1, can be formed on the inside or on the outside of the housing 1, wherein welding at both positions is also possible as shown in FIGS. 9 and 11.

In the modified example, the heat of the power switch 7*a* is transferred through the printed circuit board 7 via the welded rods 3*b* to the mounted fins from where this heat is radiated to the surrounding air.

Since the rods 3*b* in both of the above embodiments are pressed into the housing 1 or mounted and welded, a stable basic structure is achieved. This basic structure absorbs mechanical forces and moments. As a result of the rods 3*b* pressing in or the mounting and welding of the rods 3*b*, tilting is no longer possible.

As a result of the inserted sealing elements 6, the rods 3*b* are sealed towards the housing 1 and the process is arranged safely by means of force-distance measurement/monitoring. In the modified example sealing is achieved via the circumferential welded seam.

A housing cover 2 made of a plastic material completes the basic structure.

As shown especially in FIG. 6, cooling fins 1*c* constructed integral with the housing 1 are provided on the side of the housing 1 facing the heating elements 3.

The one-part housing 1 provided in the above embodiment, comprising an electrically conducting material, especially aluminium, takes over the functions of a housing, namely protection of the electronic circuits, provision of a flange for the air-conditioning box and mechanically stable accommodation of the rods 3*b*, a ground plate, accommodating the printed circuit board, transferring the heating energy generated by the power switches 7*a* to the heating elements 3, mechanically stable accommodation of the rods 3*b*, ground contacting of the printed circuit board 7 and the heating elements 3 and a ground dome, namely ground contacting of the printed circuit board 7, the heating elements 3 and the ground connection 3*b* possibly making the positive connection polarity-safe in the form of a single component.

The housing 1 is at ground potential so that there is no separate ground plate and the printed circuit board 7 can be inserted directly with the heat-conducting material 8 into the housing 1.

Figure 8:
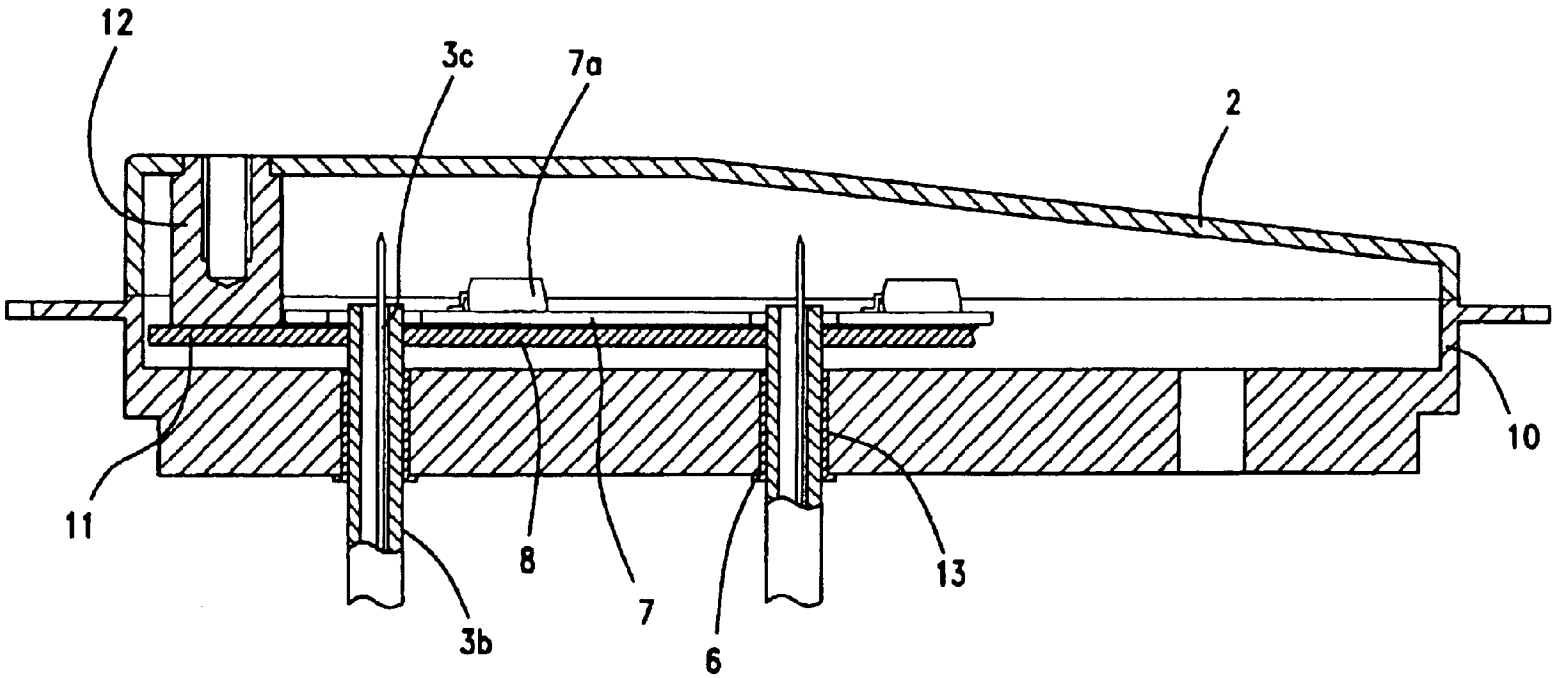
FIG. 8 (PRIOR ART)
FIG. 8 is an embodiment of a known heating apparatus in view corresponding to the sectional view along the line C—C in FIG. 5.

As shown in FIG. 8, however, in the known heating apparatus, both housing parts, namely the housing cover 2 and the housing body 10, are made of a plastic material and a ground pin 12, a ground plate 11 and a sealing compound 13 via which the heating rods 3*b* are accommodated in the housing 10, are provided separately.

In contrast to this known design, in the embodiment of the heating apparatus according to the invention described above, the heat transfer interfaces are improved since no ground plate is clamped to the heating rod but the thermal energy is removed directly from the power switches 7*a* into the heating region of the heating elements 3. By this means, an optimum transfer of heat is achieved in the direction of the heating element surface.

In the heating apparatus according to the invention, however, the housing 1 not only transfers the transported thermal energy to the heating element surface but the thermal energy is guided by the built-in housing fins 1*c* directly to the surrounding air.

Any loosening of the mechanical clamp connections provided in the known heating apparatus, when changes in temperature occur, is prevented by the one-part design of the housing 1 in which the rods 3*b* are pressed in as far as the ground connection 1*b*.

As has already been described above, as a result of the design of the aluminum housing 1 with integrally cast ground dome 1*a*, the ground potential is guided directly outwards and the ground pin, conventionally mounted separately on a ground plate, is thus unnecessary. The ground connection 1*b* can be implemented as a self-tapping screw to make both connections polarity-safe via a normal threaded connection or built in as desired by the customer. Loads caused by moments which appear during the later assembly and use of the ground connecting cable are decoupled from the printed circuit board.

The ground contact of the rods 3*b* of the heating elements 3 to the ground connection 1*b* is thus made directly via the housing 1*a*, and interfaces between a ground plate clamped to the heating rods, to the ground plate and between the ground pin affixed to the ground plate are dispensed with.

Thus, the assembly of a ground plate, a ground pin and the corresponding mechanical equipment for handling these components are superfluous in the manufacturing process.

As a result of the form-locking or form fitting, pressing in or assembly and welding of the rods 3*b* of the heating elements 3 into the housing 1, forces and moments are absorbed by the housing 1 which otherwise would be transferred to a plastic housing by the incorporation of various liquid sealing media to be hardened.

The form-fitting sealing is achieved by the sealing elements 6 mounted before pressing in the rods 3*b* or by the circumferential welded seam. As a result of the stability and seal thereby achieved, sealing materials such as a silicon bead and sealing compound can be dispensed with and the mechanical equipment necessary for this such as casting installations, furnaces, handling equipment and so on is superfluous.

What is claimed is:

1. An electrical air heating apparatus, comprising:

electrical heating elements for heating air, and a housing which has a ground connection, an electrical supply connection and an electronic circuit to control supplying of electrical power to the heating elements and at which the heating elements are arranged in electrical contact with the ground connection and the electrical supply connection, wherein the housing is constructed of an electrically conducting material and in one piece with a molded-on ground connection, and wherein the heating elements and the electronic circuit are arranged in direct electrical contact with the housing; and wherein a layer of heat-conducting material is arranged between a printed circuit board, which carries the electronic circuit for controlling the supply of electrical power to the heating elements, and the housing.

2. The heating apparatus according to claim 1, wherein the heating elements are pressed into the housing.

3. The heating apparatus according to claim 1, wherein the heating elements are arranged by a sealing element in the housing.

4. The heating apparatus according to claim 1, wherein the heating elements are mounted in the housing and welded to the housing.

5. The heating apparatus according to claim 1, wherein, on a side of the housing facing the heating elements, cooling fins are constructed integrally with the housing.

6. The heating apparatus according to claim 5, wherein the housing is made of aluminum or an aluminum alloy.

7. The heating apparatus according to claim 1, wherein, on a side of the housing facing the heating elements, cooling fins are constructed integrally with the housing.

8. The heating apparatus according to claim 1, wherein the housing is made of aluminum or an aluminum alloy.

* * * * *